United States Patent [19]

Beaman et al.

[11] 3,986,363

[45] Oct. 19, 1976

[54] ENGINE SYNCHRONIZER

[76] Inventors: Don L. Beaman, 1525 Jupiter Drive, Milpitas, Calif. 95035; Eugene C. Beaman, 2106 Shirley Road, Belmont, Calif. 94002

[22] Filed: June 3, 1974

[21] Appl. No.: 475,938

[52] U.S. Cl. ..... 60/700; 60/702; 74/501 R

[51] Int. Cl.[2] ..... F01B 21/00

[58] Field of Search ..... 60/700, 702; 74/501 R, 74/501.5 R, 501.5 H

[56] References Cited

UNITED STATES PATENTS

| | | | |
|---|---|---|---|
| 2,480,083 | 8/1949 | McMillan | 74/501 X |
| 3,367,110 | 2/1968 | Leeson, Jr. | 60/702 |

*Primary Examiner*—Allen M. Ostrager
*Attorney, Agent, or Firm*—Schapp & Hatch

[57] ABSTRACT

An engine synchronizer for synchronizing the speed of a slave engine with the speed of a master engine is disclosed. The disclosed synchronizer includes a comparison and control circuit deriving input signals from the distributors of two engines, e.g., the two engines of a power boat, one engine being arbitrarily designated the master engine and the other being arbitrarily designated the slave engine. The throttle of each engine is coupled to its associated hand throttle lever by means of a Bowden cable. One end of the sheath of the slave engine throttle control cable is attached to a slidable bracket. The slidable bracket is positioned within its limits of sliding movement by a positioning motor operating through a rack and pinion. Power to energize the positioning motor is supplied by the comparison and control circuit. The comparison and control circuit compares the times of occurrence of the ignition impulses carried by the distributors of the two engines and provides energizing pulses to the positioning motor of such duration and polarity as to position the bracket, and thus the end of the slave engine throttle control cable, to maintain the speed of the slave engine substantially equal to the speed of the master engine.

3 Claims, 2 Drawing Figures

ENGINE SYNCHRONIZER

BACKGROUND OF THE INVENTION

1. Field of the Invention

The present invention relates to improvements in synchronizing systems for synchronizing the speeds of power boat engines, and more particularly to synchronizing systems for synchronizing the speeds of engines controlled by separate hand throttle levers which are coupled to the throttles of the respective engines by means of Bowden cables.

2. Description of the Prior Art

Synchronizing systems for synchronizing the speeds of internal combustion engines, such as twin engines employed in the propulsion of boats, are well known in the art. Such prior art devices, however, have suffered certain disadvantages, such as the use of special combinations of mechanical parts, e.g., a pair of transversely-spaced worm shafts mounted for rotation in ball-bearings, and a sliding carriage; or a lengthwise, expandable or contractible link including a screw joined to the throttle control cable and engaged by a nut rotatable in a casing joined to another part of the throttle cable, the casing containing a bi-directional stepping motor having its armature connected to a pinion meshed with external gear teeth on the nut.

SUMMARY OF THE INVENTION

Accordingly, it is an object of the present invention to provide a synchronizing system for synchronizing the speeds of internal combustion engines, such as twin engines employed in the propulsion of boats, which obviates the need for complex combinations of special mechanical parts to control the throttles of the respective engines.

Another object of the present invention is to provide improved synchronizing systems for synchronizing the speeds of power boat engines, which systems may be installed without replacing or modifying the existing Bowden cables or throttle control cables used to couple the throttle valves of the respective engines to their associated hand throttle levers.

A further object of the present invention is to provide compact and rugged means for adjusting the throttle valve position of the slave engine in a master-slave engine combination, independently of the hand throttle lever of the slave engine, which is sufficiently small and compact so as to be easily mounted on the slave engine along the path of the slave engine throttle control cable and closely adjacent the slave engine carburetor for directly controlling the position of the end of the control cable.

Other objects of the invention will in part be obvious, and will in part appear hereafter.

The invention, accordingly, comprises the features of construction, combination of elements, and arrangement of parts, which will be exemplified in the construction hereinafter set forth, and the scope of the invention will be indicated in the claims.

In accordance with a particular feature of the present invention there is provided throttle adjusting means for adjusting the throttle valve position of a slave engine independently of the position of a throttle lever which controls the throttle valve position by means of a control cable having an inner wire coupled to the throttle lever and the throttle valve and axially slidable in a sheath closely surrounding the wire, comprising first bracket means mounted on said slave engine adjacent the path of said control cable, second bracket means slidable with respect to said first bracket means, attaching means for attaching said sheath to said second bracket means, and motor means for sliding said second bracket means with respect to said first bracket means to displace at least the end of said cable adjacent the slave engine with respect to the engine and thereby adjust the throttle valve position without displacing the throttle lever.

In accordance with another feature of the present invention, said motor means and a comparison and control circuit for comparing the times of appearance of the firing impulses of said slave engine and the firing impulses of a master engine and supplying energizing impulses to said motor means are mounted in a common housing which is affixed to said first bracket means.

For a fuller understanding of the nature and objects of the invention, reference should be had to the following detailed description, taken in connection with the accompanying drawing.

DESCRIPTION OF THE PREFERRED EMBODIMENT

Figure 1:
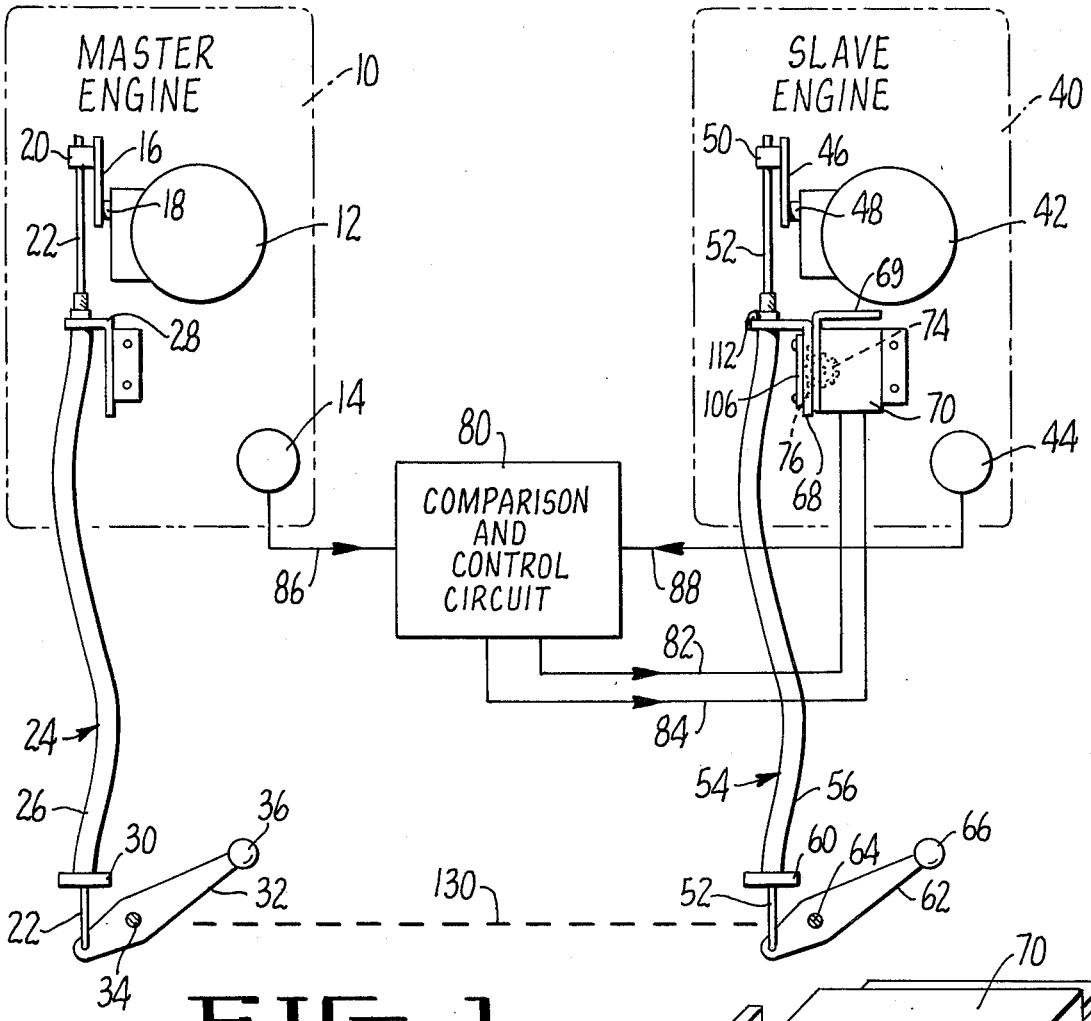
FIG. 1 is a schematic representation of an engine synchronizing system embodying the present invention.

Referring first to FIG. 1, there is shown a master engine 10 having a carburetor 12 and a distributor 14. Carburetor 12 is equipped, in the well-known manner, with a throttle valve (not shown) the position of which is controlled by a throttle arm 16. Throttle arm 16 is irrotatably affixed to a pivot rod 18 for conjoint rotation therewith, the throttle valve being connected to pivot rod 18 in the well-known manner.

Throttle arm 16 is provided at its outer end with a pivot 20 to which is attached one end of the wire 22 of throttle control cable 24.

Throttle control cable 24 is of the type sometimes known as a Bowden cable, consisting of an internal wire 22 and an outer sheath 26. Wire 22 is longitudinally slidable within sheath 26. Sheath 26 closely surrounds wire 22, and, in the well-known manner, consists of one or more layers of spirally wrapped wire, such that it is semi-rigid.

In the well-known manner, the end of sheath 26 adjacent carburetor 12 is fixed in position with respect to carburetor 12, as by bracket 28, which is itself affixed to master engine 10. The other end of sheath 26 is affixed to the structure of the boat by means of a bracket 30. Bracket 30 is located closely adjacent master engine hand throttle lever 32, which may, for instance, be located in the cockpit or on the control bridge of the boat. Hand throttle lever 32 is pivoted for manual motion about a pivot 34, which is itself fixed in position with respect to bracket 30. One end of control wire 22 of Bowden cable 24 is pivotably affixed to the end of hand throttle control lever 32 opposite its knob or handle 36. Thus, it will be seen that the throttle valve or throttle plate of carburetor 12 may be selectively positioned by the manipulation of hand throttle control lever 32, and the speed of master engine 10 thereby manually controlled.

It will be recognized by those having ordinary skill in the art that the linkage extending from hand throttle control lever 32 to the throttle or throttle plate of carburetor 12, via Bowden cable 24, as just described, is conventional, and will be found in many power boats.

Referring yet further to FIG. 1, there is shown a slave engine 40 having a carburetor 42 and a distributor 44. Carburetor 42 is provided with a throttle arm 46 affixed to the end of a pivot rod 48. Affixed to the outer end of throttle arm 46 is a pivot 50. Throttle control cable 54 is of the type well-known as a Bowden cable, consisting of wire 52 and sheath 56 closely surrounding it. Wire 52 is longitudinally slidable within sheath 56. The end of sheath 56 remote from the slave engine is affixed to the structure of the boat by means of a bracket 60, similar to the above-described bracket 30. A slave engine hand throttle lever 62 is mounted on a pivot 64 closely adjacent bracket 60, and the speed of slave engine 40 may be controlled by the manual displacement of knob 66 of hand throttle control lever 62, thereby pivoting control lever 62 about pivot 64, and moving wire 52 into and out of sheath 56, whereby the throttle plate or throttle valve of carburetor 42 is angularly moved by the cooperation of the other end of wire 52 with throttle control arm 56 via pivot 50.

In accordance with the present invention, the end of sheath 56 adjacent carburetor 42 is affixed to a movable bracket 58, which is described in detail hereinbelow. Mounted on slave engine 40 by means of bracket 69 is a housing 70 containing a motor 72 having a pinion gear 74 irrotatably affixed to its shaft for conjoint rotation therewith.

In accordance with the principles of the present invention, the comparison and control circuit which provides energizing impulses to motor 72 may be mounted in housing 70.

As described hereinafter, bracket 68 is slidably mounted on housing 70 to allow limited sliding of bracket 68 with respect to housing 70, so that the end of sheath 56 may be displaced for a limited distance along the axis of the relatively straight end portion of wire 52 adjacent carburetor 42.

As may be seen in FIG. 1, bracket 68 is provided on its inner face adjacent housing 70 with a rack 76. The teeth of rack 76 mesh with the teeth of pinion 74, and thus the position of rack 76, and the end of sheath 56, may be altered by the rotation of the shaft of motor 72.

In a preferred embodiment of the present invention motor 72 may be a compact, inexpensive permanent magnet field, direct current, fractional horsepower motor, rather than a relatively expensive bi-directional stepping motor of the kind employed in some devices of the prior art.

Current impulses for energizing motor 72 to reposition bracket 76, and the end of cable sheath 56, to synchronize the speed of slave engine 40 with the speed of master engine 10 are provided by comparison and control circuit 80, via leads 82 and 84.

The input signals to comparison and control circuit 80, indicating the speeds of master engine 10 and slave engine 40, respectively, are derived from distributors 14 and 44 via leads 86 and 88.

Comparison and control circuit 80 generally comprises a pair of Schmidt trigger circuits each receiving as its input signal the firing impulses from a corresponding one of the distributors 14, 44. The output circuit of each Schmidt trigger is applied to a monostable multivibrator used as a pulse shaping network. The output signals of these monostable multivibrators are applied respectively to the inputs of a pair of D-type edge-triggered flip-flop circuits.

When the speeds of the two engines deviate, one of these flip-flop circuits is turned on by rising voltage at its input, and off by a pulse from the opposite engine. If two "on" pulses are received before an "off" pulse from the opposite engine a logic circuit is enabled, which triggers a pulse generator to deliver a timed pulse to the input of a power amplifier circuit, thus applying a power impulse of corresponding polarity (current direction) to motor 72, and adjusting the position of the end of sheath 56 and the position of the throttle plate or throttle valve of carburetor 42 to adjust the speed of the slave engine toward equality with the speed of the master engine.

Figure 2:
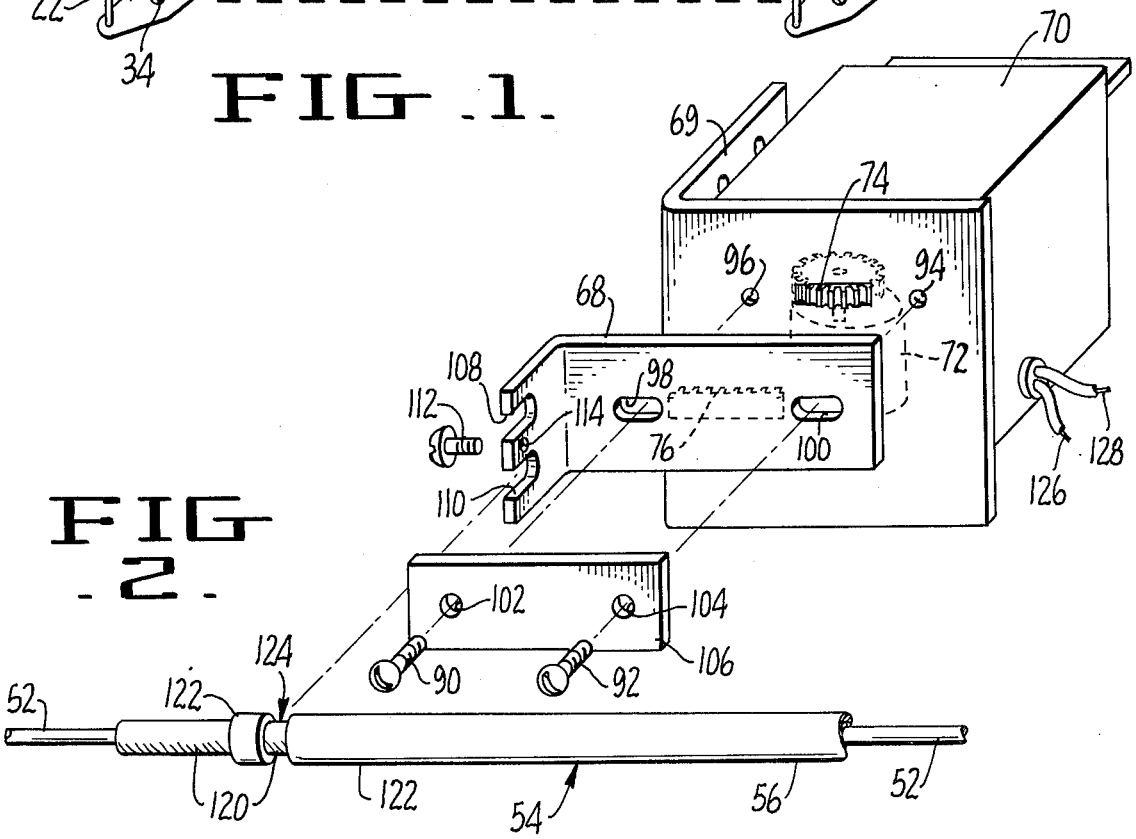
FIG. 2 is an exploded perspective view, partly in phantom, of a slave engine throttle adjustment assembly embodying the present invention.

Referring now to FIG. 2, it will be seen that movable bracket 68 is slidably mounted on housing 70 by means of a pair of screws 90, 92, which engage tapped holes 94, 96 in the face of housing 70 against which bracket 68 bears. The shank portions of screws 90 and 92 pass through corresponding clearance slots 98 and 100 in bracket 68, after first passing through corresponding elongated holes 102, 104 in guide plate 106. Rack 76 is recessed below the rear face of bracket 68 (as seen in FIG. 2), and thus the rear face of bracket 68 slides over the forward face of housing 70 (as seen in FIG. 2) when the shaft of motor 72 rotates due to the inter-engagement of the teeth of pinion 74 and rack 76.

The outer end of bracket 68 as shown in FIG. 2 is provided with a pair of open-ended slots 108, 110, either one of which is adapted to receive and engage the end of cable sheath 56 in the manner described hereinbelow. A screw 112 received in tapped hole 114 is provided for maintaining the end of sheath 56 in position in either one of said slots.

As seen at the bottom of FIG. 2, sheath 56 of the type of Bowden cable employed in the preferred embodiment consists of one or more spring wire wrappings 120 and an outer cover 122. Slots 108 and 110 in the outer end of bracket 68 are so wide as to close-fittingly receive spring wrappings 120, but are not wide enough from side to side so as to receive outer cover 122 of Bowden cable sheath 56. Thus, a gap 124 may be provided in outer cover 122 such that the thus bared portion of spring wrapping 120 may be slid into one of the slots 108, 110. After the bared portion 124 of cable sheath 56 is fully bottomed in one of the slots 108, 110 screw 112 may be screwed into tapped hole 114, thereby locking the end of sheath 56 into bracket 68.

It will be evident to those having ordinary skill in the art that electrical leads 126, 128 will correspond to leads 82, 84 (FIG. 1) if comparison and control circuit 80 is located outside housing 70, and otherwise will correspond to leads 86, 88 (FIG. 1).

Further, it will be evident to those having ordinary skill in the art that hand throttle levers 32, 62 (FIG. 1) may be coordinated in their operation by well-known mechanical means represented by dashed line 130, if desired.

It will thus be seen that the objects set forth above, among those made apparent from the preceding description, are efficiently attained, and, since certain changes may be made in the above construction without departing from the scope of the invention, it is intended that all the matter contained in the above description or shown in the accompanying drawing shall be interpreted as illustrative only, and not in a limiting sense.

It is also to be understood that the following claims are intended to cover all of the generic and specific features of the invention herein described, and all statements of the scope of the invention which, as a matter of language, might be said to fall therebetween.

What is claimed is:

1. Throttle adjusting means for adjusting the throttle valve position of a slave engine independently of the position of a remote throttle lever which controls the throttle valve position by means of a control cable having an inner wire coupled to the throttle lever and to the throttle valve and a sheath closely surrounding the wire, comprising:

first bracket means mounted on said slave engine adjacent the path of said control cable;

second bracket means slidable with respect to said first bracket means;

attaching means for attaching said sheath to said second bracket means; and motor means for sliding said second bracket means with respect to said first bracket means to displace at least the end of said cable adjacent the slave engine with respect to the engine and thereby adjust the throttle valve position without displacing said throttle lever.

2. Throttle adjusting means as claimed in claim 1 in which a comparison and control circuit means for comparing the times of occurrence of the firing impulses of said slave engine and the firing impulses of a master engine and supplying energizing impulses to said motor means is mounted on said first bracket.

3. Throttle adjusting means as claimed in claim 2 in which said motor means and said comparison and control circuit means are mounted in a common housing which is affixed to said slave engine by means of said first bracket.

* * * * *